US010148374B2

(12) United States Patent
Helm et al.

(10) Patent No.: US 10,148,374 B2
(45) Date of Patent: Dec. 4, 2018

(54) SYSTEMS AND METHODS FOR ALTERING AN IN-VEHICLE PRESENTATION

(75) Inventors: Sean L. Helm, Saline, MI (US); Jeffery E. Pierfelice, Canton, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 492 days.

(21) Appl. No.: 13/453,614

(22) Filed: Apr. 23, 2012

(65) Prior Publication Data

US 2013/0279308 A1 Oct. 24, 2013

(51) Int. Cl.
*H04H 60/27* (2008.01)

(52) U.S. Cl.
CPC ..... *H04H 60/27* (2013.01)

(58) Field of Classification Search
CPC ..... G05D 2201/0213; G05D 1/0223; G08G 1/096725; G08G 1/096775; G08G 1/163; G06K 9/3233; G06K 11/006; H04W 48/04; H04W 4/021; H04W 4/046; H04W 48/02; H04W 48/14; H04W 48/18; H04W 4/02; H04W 4/027; H04W 4/029; H04W 60/04; H04W 68/005; H04W 76/50; G01C 21/00; G01C 21/12; G01C 21/16; G01C 21/20; G01C 21/28; G01C 21/3047; G01C 21/3476; H04M 1/6091; H04M 1/72577; H04M 2250/10; H04M 2250/12; H04M 2250/52; H04M 29/00
See application file for complete search history.

(56) References Cited

U.S. PATENT DOCUMENTS 6,028,537 A * 2/2000 Suman ..... B60K 35/00 340/426.14
6,198,996 B1 * 3/2001 Berstis ..... B60R 25/2018 701/36
6,233,468 B1 * 5/2001 Chen ..... H01Q 1/103 343/702
6,282,464 B1 * 8/2001 Obradovich ..... B60G 17/0195 340/988
6,850,252 B1 * 2/2005 Hoffberg ..... G06K 9/00369 348/E7.061
7,006,881 B1 * 2/2006 Hoffberg ..... G05B 15/02 700/17
7,187,947 B1 * 3/2007 White ..... G06Q 30/0267 455/556.1
7,248,872 B2 * 7/2007 Bassett ..... G06F 17/30575 455/414.2

(Continued)

FOREIGN PATENT DOCUMENTS

GB 2483857 A * 3/2012
JP 2002-236023 * 8/2002

(Continued)

*Primary Examiner* — Yogeshkumar Patel
(74) *Attorney, Agent, or Firm* — Dinsmore & Shohl LLP

(57) ABSTRACT

Systems and methods for altering an in-vehicle presentation are provided. One embodiment includes receiving a media signal at a vehicle that includes content, providing an in-vehicle presentation of the content for viewing as the media signal is being received, and determining a triggering action to alter output of the in-vehicle presentation in a predetermined manner. Some embodiments include altering the in-vehicle presentation in the predetermined manner in response to receiving the triggering action, beginning recording of the content in response to altering the in-vehicle presentation, and providing an option to store the content that is being recorded.

15 Claims, 11 Drawing Sheets

(56) References Cited

U.S. PATENT DOCUMENTS 7,319,869 B2 * 1/2008 Dietz ..... H04B 1/207 455/422.1
7,343,141 B2 * 3/2008 Ellis ..... H04B 1/20 348/553
7,606,938 B2 * 10/2009 Roese ..... G01S 5/02 709/242
7,929,979 B2 * 4/2011 Konno ..... 455/456.4
7,974,714 B2 * 7/2011 Hoffberg ..... G06K 9/00369 360/75
7,978,621 B2 * 7/2011 Rofougaran ..... H04W 52/0261 370/252
7,983,222 B2 * 7/2011 Giaimo ..... H04W 72/02 370/332
8,036,822 B2 * 10/2011 Ho ..... G01C 21/3407 340/988
2002/0094787 A1 * 7/2002 Avnet ..... G06Q 30/02 455/68
2002/0104083 A1 * 8/2002 Hendricks ..... H04H 20/10 725/34
2002/0112247 A1 * 8/2002 Horner ..... G06F 17/30017 725/112
2002/0171673 A1 * 11/2002 Brown ..... G06Q 10/06 715/700
2003/0036823 A1 * 2/2003 Mahvi ..... B60K 28/063 701/1
2003/0037075 A1 * 2/2003 Hannigan ..... G06Q 30/02 715/201
2003/0080878 A1 * 5/2003 Kirmuss ..... 340/936
2003/0229434 A1 * 12/2003 Miedema ..... A01B 79/005 701/50
2004/0045030 A1 * 3/2004 Reynolds ..... H04L 29/06 725/110
2004/0133927 A1 * 7/2004 Sternberg ..... G06F 17/30247 725/136
2004/0162645 A1 * 8/2004 Obradovich ..... B60G 17/0195 701/1
2004/0268387 A1 * 12/2004 Wendling ..... H04N 5/4401 725/35
2005/0020223 A1 * 1/2005 Ellis ..... H04B 1/20 455/186.1
2006/0009234 A1 * 1/2006 Freer ..... H04W 4/02 455/456.1
2006/0235753 A1 * 10/2006 Kameyama ..... B60H 1/00742 705/15
2006/0253330 A1 * 11/2006 Maggio ..... G06Q 30/02 705/14.2
2007/0126604 A1 * 6/2007 Thacher ..... G01C 21/26 340/995.13
2007/0186165 A1 * 8/2007 Maislos ..... G06Q 30/02 715/728
2007/0192038 A1 * 8/2007 Kameyama ..... G01C 21/3641 702/19
2007/0217626 A1 * 9/2007 Sharma ..... G06T 1/0028 381/100
2007/0244614 A1 * 10/2007 Nathanson ..... G07C 5/008 701/33.4
2007/0250194 A1 * 10/2007 Rhoads ..... G06Q 30/00 700/94
2007/0250901 A1 * 10/2007 McIntire ..... H04N 7/17318 725/146
2007/0300153 A1 * 12/2007 Newman ..... H04L 29/06 715/234
2008/0028422 A1 * 1/2008 Cohen ..... G06F 21/10 725/32
2008/0042840 A1 * 2/2008 Christopher ..... G06Q 30/02 340/572.1
2008/0113673 A1 * 5/2008 Brown ..... H04W 4/02 455/456.1
2008/0119994 A1 * 5/2008 Kameyama ..... B60W 40/08 701/48
2008/0194196 A1 * 8/2008 Angelhag ..... H04L 29/06027 455/3.06
2008/0220715 A1 * 9/2008 Sinha ..... H04W 48/04 455/1
2008/0243373 A1 * 10/2008 Cat ..... G01C 21/26 701/408
2008/0271072 A1 * 10/2008 Rothschild ..... H04H 60/50 725/35
2008/0309451 A1 * 12/2008 Zellweger ..... G07C 9/00309 340/3.32
2009/0061919 A1 * 3/2009 Rofougaran ..... H04W 52/146 455/522
2009/0070797 A1 * 3/2009 Ramaswamy ..... H04L 12/66 725/10
2009/0081971 A1 * 3/2009 Rofougaran ..... H04W 52/0245 455/127.1
2009/0081972 A1 * 3/2009 Rofougaran ..... H04W 52/245 455/127.1
2009/0146846 A1 * 6/2009 Grossman ..... B60R 25/04 340/988
2009/0158318 A1 * 6/2009 Levy ..... G06F 21/125 725/32
2009/0177742 A1 * 7/2009 Rhoads ..... G06Q 30/00 709/203
2009/0204906 A1 * 8/2009 Irving ..... H04N 7/15 715/753
2009/0253455 A1 * 10/2009 Huang ..... H04M 1/72563 455/550.1
2009/0300511 A1 * 12/2009 Behar ..... G06F 1/162 715/745
2009/0303676 A1 * 12/2009 Behar ..... G06F 1/162 361/679.27
2009/0322790 A1 * 12/2009 Behar ..... G06F 1/162 345/659
2010/0077436 A1 * 3/2010 Barnes ..... H04N 7/17318 725/75
2010/0083338 A1 * 4/2010 Chiang ..... H04N 5/4403 725/139
2010/0112945 A1 * 5/2010 Hanif ..... H04L 12/2816 455/41.2
2010/0153846 A1 * 6/2010 Roy ..... G06F 17/30749 715/716
2010/0175006 A1 * 7/2010 Li ..... G06F 17/30672 715/764
2010/0175014 A1 * 7/2010 Obradovich ..... B60G 17/0195 715/771
2010/0185306 A1 * 7/2010 Rhoads ..... G06Q 30/00 700/94
2010/0191608 A1 * 7/2010 Mikkelsen ..... G06Q 30/0601 705/26.1
2010/0262465 A1 * 10/2010 Vasilakos ..... G06Q 30/02 705/14.1
2010/0268412 A1 * 10/2010 Mori ..... B60W 10/30 701/31.4
2010/0283591 A1 * 11/2010 Schick ..... B60K 35/00 340/436
2010/0305807 A1 * 12/2010 Basir ..... B60R 16/0373 701/31.4
2010/0330975 A1 * 12/2010 Basir ..... H04L 67/12 455/418
2011/0171978 A1 * 7/2011 Konno ..... H04W 48/04 455/456.4
2012/0244874 A1 * 9/2012 Behairy ..... H04W 4/021 455/456.1
2013/0017806 A1 * 1/2013 Sprigg ..... H04M 1/66 455/411
2013/0183924 A1 * 7/2013 Saigh ..... H04W 4/029 455/404.2
2013/0344859 A1 * 12/2013 Abramson ..... G06Q 50/265 455/418

FOREIGN PATENT DOCUMENTS

JP 2002/236023 * 8/2002
JP 2002-236023 A * 8/2002

* cited by examiner

SYSTEMS AND METHODS FOR ALTERING AN IN-VEHICLE PRESENTATION

TECHNICAL FIELD

Embodiments described herein generally relate to altering an in-vehicle presentation and, more specifically, to pausing playback and/or changing an audio setting, based on a triggering event.

BACKGROUND

In many current vehicles, users are provided with audio and/or presentations. These presentations may include live presentations, such as terrestrial radio broadcasts, satellite radio broadcasts, and/or internet broadcasts. While these in-vehicle systems currently provide an improved environment for the vehicle users, the excessive sound that these in-vehicle systems produce may reduce the overall vehicle experience and/or may conflict with local ordinances.

SUMMARY

Systems and methods for altering an in-vehicle presentation are provided. One embodiment includes receiving a media signal at a vehicle that includes content, providing an in-vehicle presentation of the content for viewing as the media signal is being received, and determining a triggering action to alter output of the in-vehicle presentation in a predetermined manner. Some embodiments include altering the in-vehicle presentation in the predetermined manner in response to determining the triggering action, beginning recording of the content in response to altering the in-vehicle presentation, and providing an option to store the content that is being recorded.

In another embodiment, a system for altering an in-vehicle presentation includes logic that when executed by the system, causes the system to receive a media signal for presentation in a vehicle, provide an in-vehicle presentation of the content for viewing as the media signal is being received, and receive a first triggering action to pause output of the in-vehicle presentation. In some embodiments, in response to receiving the first triggering action, the logic causes the system to pause the in-vehicle presentation and begin recording the content, receive a second triggering action to resume playback of the in-vehicle presentation at a point the in-vehicle presentation was paused, and provide an option to playback the in-vehicle presentation at a faster pace than the an original pace of in-vehicle presentation until the playback reaches an end of the recorded content.

In yet another embodiment, a vehicle includes a vehicle computing device that stores logic that, when executed by the vehicle computing device, causes the vehicle computing device to receive a media signal that includes content, provide an in-vehicle presentation of the content for viewing as the media signal is being received, and receive a first triggering action to lower the maximum audio setting of the in-vehicle presentation. In some embodiments, in response to receiving the first triggering action, the logic causes the vehicle computing device to lower the maximum audio setting of the in-vehicle presentation, determine whether a current volume is greater than the maximum audio setting, and in response to determining that the current volume is greater than the maximum audio setting, lower the current volume to the maximum audio setting and, in response to receiving a second triggering action to return the maximum audio setting, return the maximum audio setting and the current volume.

These and additional features provided by the embodiments of the present disclosure will be more fully understood in view of the following detailed description, in conjunction with the drawings.

BRIEF DESCRIPTION OF THE DRAWINGS

The embodiments set forth in the drawings are illustrative and exemplary in nature and not intended to limit the disclosure. The following detailed description of the illustrative embodiments can be understood when read in conjunction with the following drawings, where like structure is indicated with like reference numerals and in which.

DETAILED DESCRIPTION

Embodiments disclosed herein include systems and methods for altering an in-vehicle presentation. Accordingly, some embodiments are configured to automatically pause live-broadcast of terrestrial and satellite radio. Such embodiments also provide a mechanism to automatically pause/record based on pre-determined conditions. While paused, the live broadcast may be cached and played back after the pause is discontinued or when the predetermined condition ceases to occur. The predetermined conditions for automatic pause/record could include opening the fuel door when pumping gas, lowering the window when traveling at slow speeds, during phone calls, etc. Additionally, some embodiments may be configured to freeze the in-vehicle user interface during the pause. Some embodiments may also include an intelligent skip feature that allows the user to fast forward or "skip" over text between songs (e.g., skip from the end of one song, over intermediate text/data, to the beginning of the next song). Still some embodiments may provide an increased speed playback feature. The increased speed playback feature allows playback of the paused content to more quickly return to the live broadcast without skipping content.

Embodiments of this disclosure may also be configured to modify audio settings, such as a volume threshold of the audio system based on the location of the vehicle as determined through the vehicle navigation system. When the vehicle enters a geographic location that has an associated audio setting, the vehicle computing device automatically adjusts the audio settings. The audio settings that are adjusted may include the equalizer setting (bass, treble, etc.) maximum volume setting, overall volume, and/or other settings. This feature may be utilized to bring the audio system noise of the vehicle into compliance with local regulations or other constraints. Similarly, the feature may be utilized as a "parental control" feature to prevent younger drivers from listening to excessively loud music while driving on residential streets.

Figure 1:
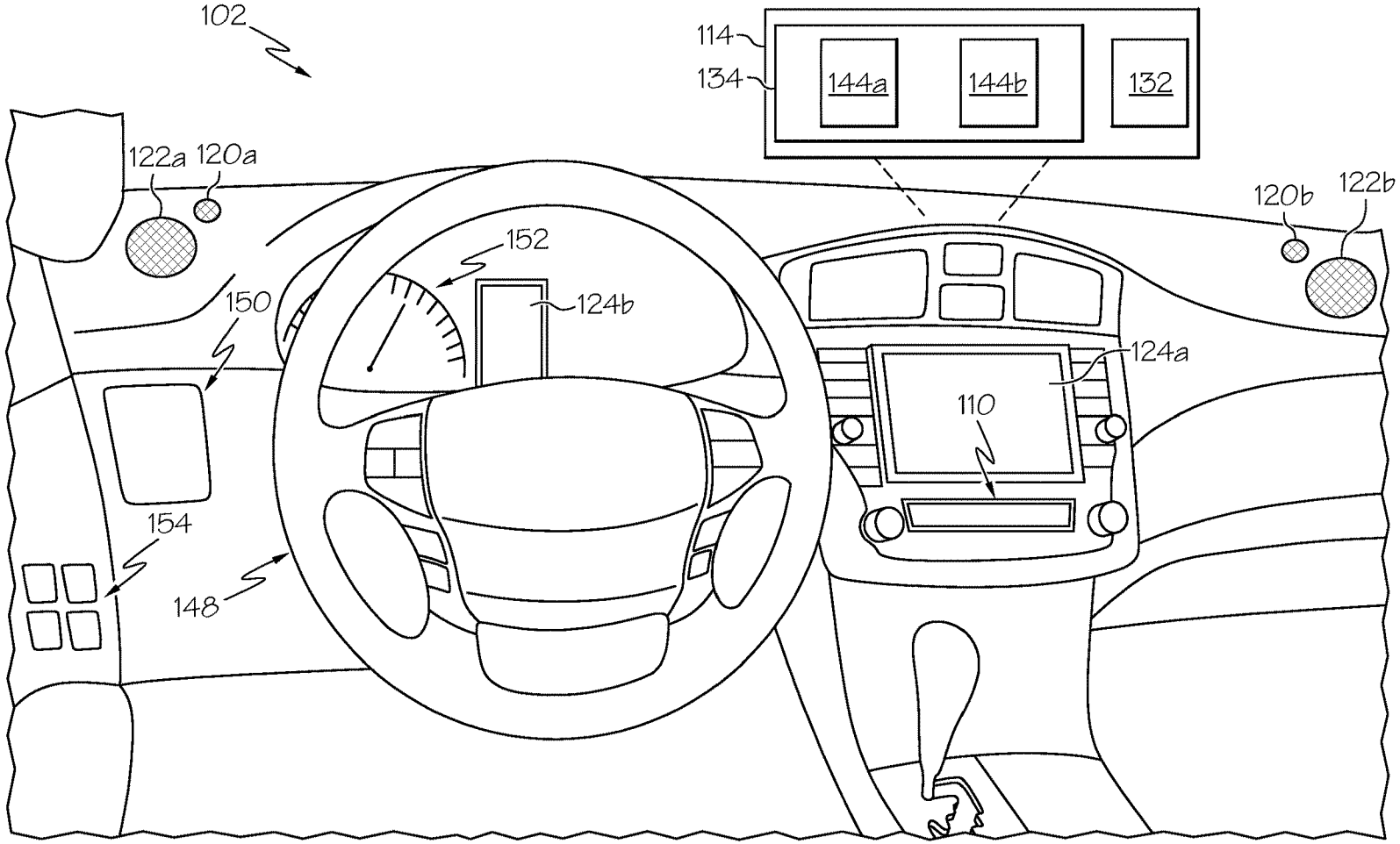
FIG. 1 schematically depicts a vehicle interior for altering an in-vehicle presentation therein, according to embodiments disclosed herein.

Referring now to the drawings, FIG. 1 schematically depicts an interior portion of a vehicle 102 for altering an in-vehicle presentation therein, according to embodiments disclosed herein. As illustrated, the vehicle 102 may include a console display 124*a* and a dash display 124*b* (referred to independently and/or collectively herein as "display device 124"). The console display 124*a* may be configured to provide one or more user interfaces and may be configured as a touch screen and/or include other features for receiving user input. The dash display 124*b* may similarly be configured to provide one or more interfaces, but often the data provided in the dash display 124*b* is a subset of the data provided by the console display 124*a*. Regardless, at least a portion of the user interfaces depicted and described herein may be provided on either or both the console display 124*a* and the dash display 124*b*.

Also included in the vehicle 102 is a content playback device 110, which may include a tape player, a compact disc player, a digital video disc player, a media file player, a radio signal receiver, a television signal receiver, an internet receiver, a navigation system, etc. The content playback device 110 may be operated via a touch screen of the display device 124, and/or one or more other inputs, such as on the dashboard and/or a steering wheel 148 of the vehicle 102. Also coupled to the content playback device 110 and/or display device 124 are one or more microphones 120*a*, 120*b* and one or more speakers 122*a*, 122*b*. The one or more microphones 120*a*, 120*b* may be configured for receiving user voice commands and/or other inputs. Similarly, the speakers 122*a*, 122*b* may be utilized for providing audio content from the content playback device 110 to the user. The content playback device 110, microphones 120, speakers 122, and/or related components may represent an in-vehicle audio system.

Figure 11:
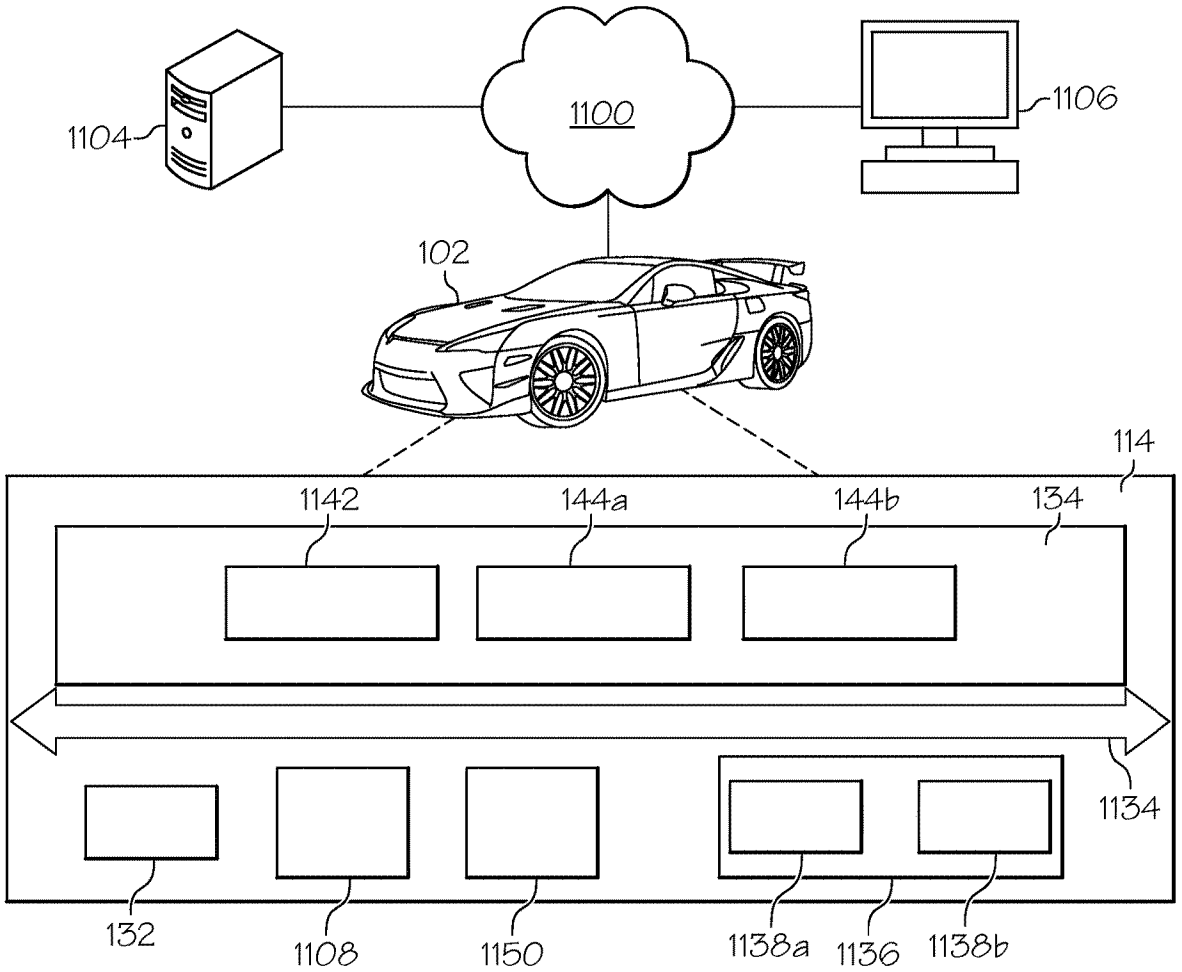
FIG. 11 depicts a network environment for altering an in-vehicle presentation, according to embodiments disclosed herein.

Also included in the vehicle 102 is a vehicle computing device 114. The vehicle computing device 114 may be configured with a processor 132 and a memory component 134, which may store altering logic 144*a* and triggering logic 144*b*. The altering logic 144*a* and the triggering logic 144*b* may each include a plurality of different pieces of logic, each of which may be embodied as a computer program, firmware, and/or hardware, as an example. The altering logic 144*a* may be configured to cause the vehicle computing device 114 to alter the playback of content. Similarly, the triggering logic 144*b* may be configured to identify whether a triggering action has occurred to begin altering the content playback. Additional components of the vehicle 102 are depicted in FIG. 11 and described in more detail below.

Also included in the vehicle 102 are a fuel door option 150, a speedometer 152, and a window control option 154. Specifically, the fuel door option 150 may include a release for opening a fuel door to refuel. The fuel door option 150 may also include a sensor to determine when the fuel door is open and/or a sensor to determine a fuel level.

Similarly, the speedometer 152 may be utilized to determine a current speed of the vehicle 102. The window control option 154 may be utilized to lower and raise one or more of the windows of the vehicle 102. As discussed in more detail below, the vehicle computing device 114 may determine whether one or more of the windows have been lowered. If so, the vehicle computing device 114 may determine the current speed of the vehicle 102. If the current speed is greater than a predetermined threshold speed, the vehicle computing device 114 may determine that a triggering action has occurred and alter the in-vehicle presentation. Similarly, other triggering actions may be detected by the vehicle computing device 114 for altering the in-vehicle presentation.

Figure 2:
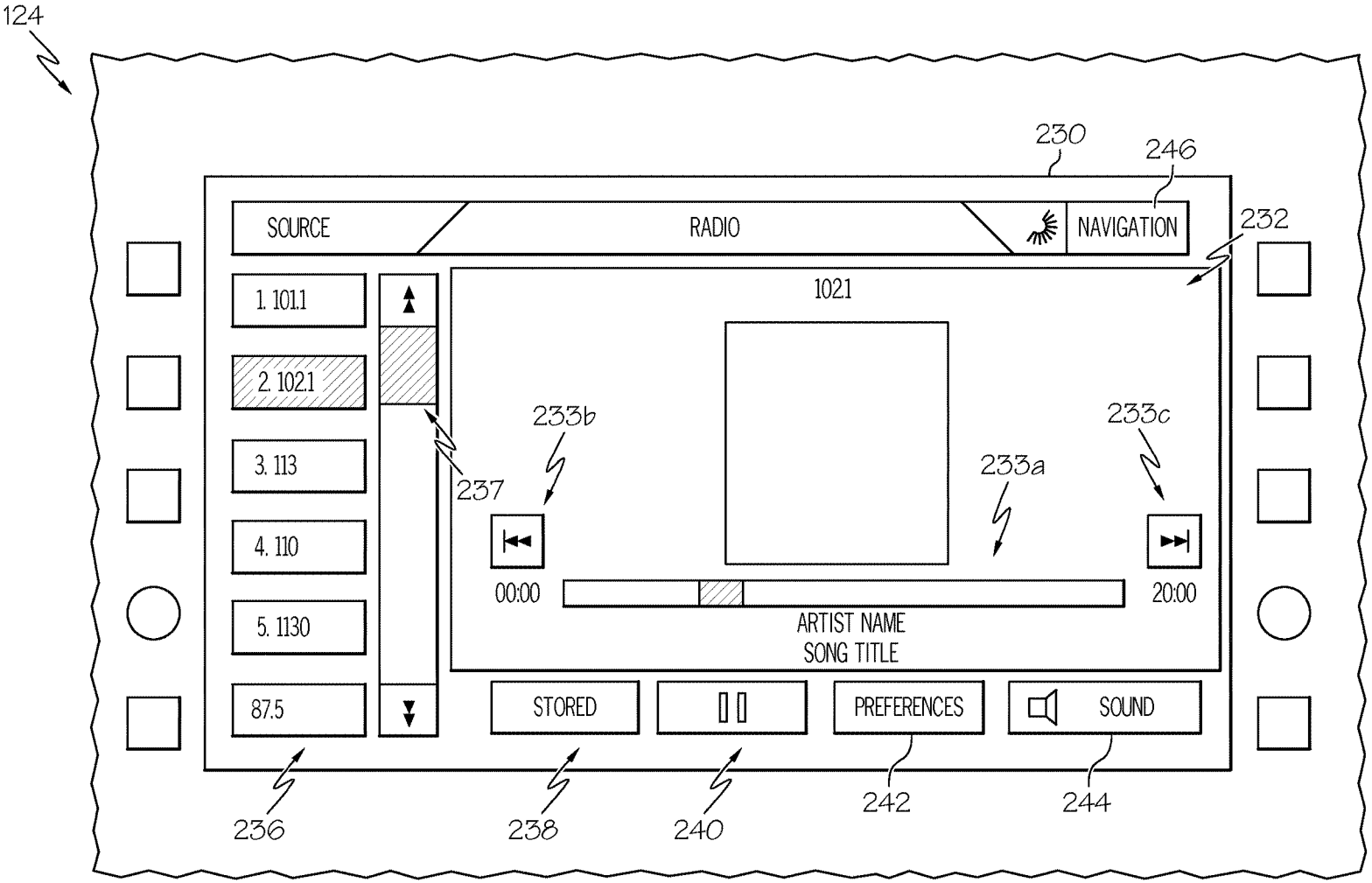
FIG. 2 depicts an in-vehicle user interface for providing content to a vehicle user, according to embodiments disclosed herein.

FIG. 2 depicts an in-vehicle user interface 230 for providing content to a vehicle user, according to embodiments disclosed herein. As illustrated, the in-vehicle user interface 230 may be provided on the display device 124 of the vehicle 102. The in-vehicle user interface 230 includes a currently playing section 232 for providing the content that is currently playing in the vehicle 102. The currently playing section 232 may include a progress option 233*a*, reverse option 233*b*, and a forward option 233*c*. The progress option 233*a* may be utilized for informing the user of the progress of the currently playing media and/or provide an option for the user to manually select a time on the currently playing media to play. The reverse option 233*b* may be utilized for rewinding or restarting the currently playing media. Similarly, the forward option 233*c* may be utilized for fast forwarding or skipping the currently playing media.

Also included is a channel section 236 for selecting different channels. The channel section 236 may include a plurality of channels from which the user can select. As indicated in the in-vehicle user interface 230, channel 2 (102.1) has been selected. Additional channels may be selected by a user selection of the scroll bar 237.

The in-vehicle user interface 230 may also include a stored option 238, a pause option 240, a preferences option 242, and a sound option 244. In response to selection of the stored option 238, the previously stored content may be provided for playback. This may include radio content that was recorded and stored, as discussed in more detail, below. Similarly, in response to selection of the pause option 240, the currently playing content may be paused and buffered for resuming at a future time. As an example, if the currently playing content is received from a radio signal, the vehicle computing device 114 may begin recording the received signal. Additionally, the vehicle computing device 114 may pause playback of the currently playing content.

In response to selection of the preferences option 242, additional options may be provided, such as user settings, display setting, etc. Similarly, in response to selection of the sound option 244, one or more audio settings may be provided. The audio settings may include volume settings, maximum volume level settings, volume equalizer settings, bass settings, treble settings, balance settings, etc. Other sound related settings may also be provided.

Specifically, the vehicle 102 may receive a media signal, such as a radio signal. The media signal may include a content portion and a metadata portion. The content portion may include the audio and/or video that is played in the vehicle 102. The metadata portion may provide data related to the content that is being received, such as title, artist name, album title, etc. Accordingly, the content portion may be provided for display, such as through the speaker 122 (FIG. 1), while the metadata portion may be provided via the display device 124, as depicted in the in-vehicle user interface 230.

Also included is a navigation option 246. The navigation option 246 may provide one or more in-vehicle user interfaces associated with the navigation system. The navigation system may utilize global positioning and/or other technologies for identifying a current location of the vehicle 102. Additionally, the navigation system may communicate (and/or be part of) the vehicle computing device 114 to identify locations for altering an in-vehicle presentation, as discussed in more detail below.

Figure 3:
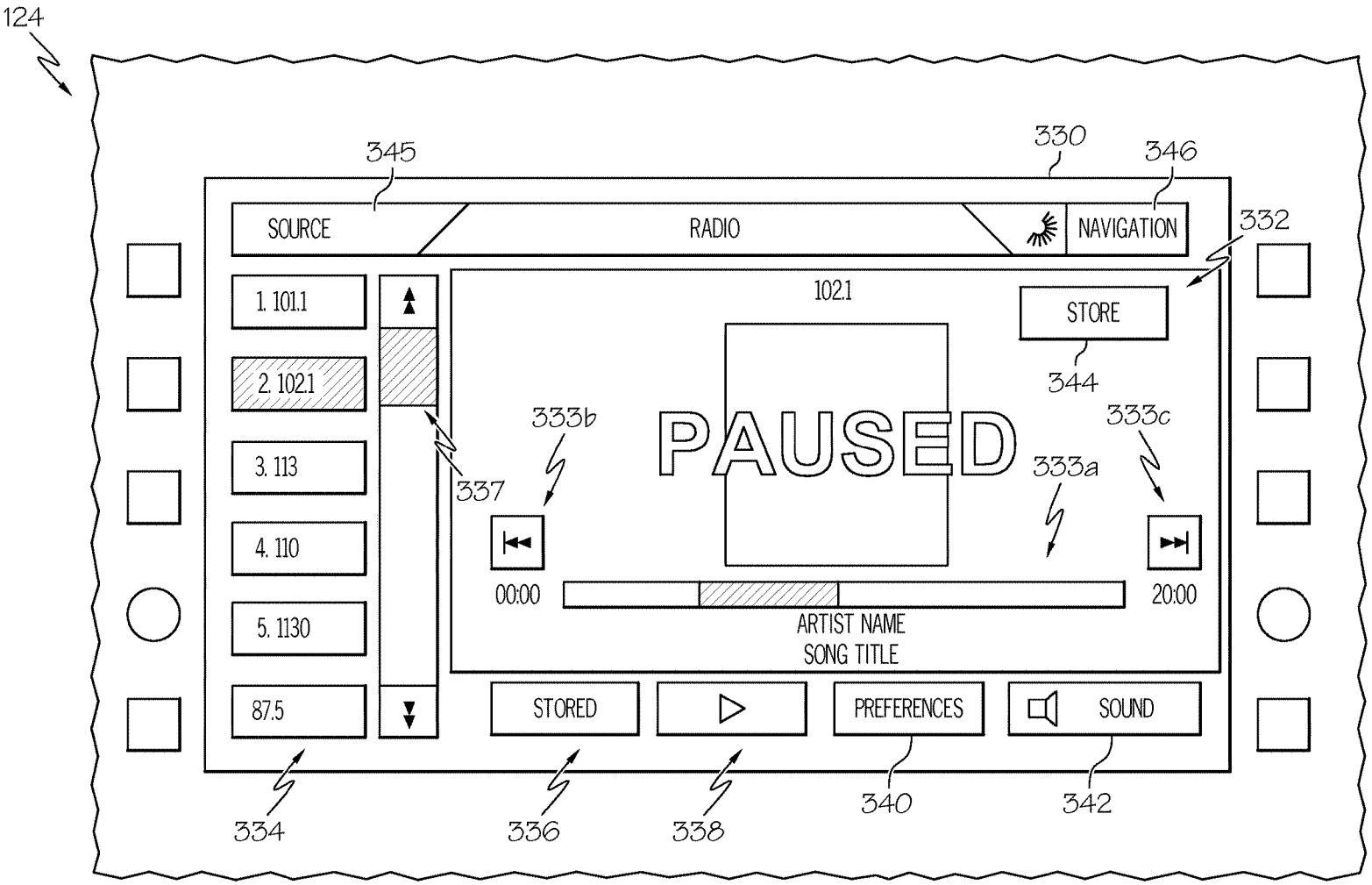
FIG. 3 depicts an in-vehicle user interface for pausing playback of received content, such as a radio broadcast, according to embodiments disclosed herein.

FIG. 3 depicts an in-vehicle user interface 330 for pausing playback of received content, such as a radio broadcast, according to embodiments disclosed herein. In response to selection of the pause option 240 from FIG. 2 and/or detection of another triggering event, the received live broadcast may be paused and the display may be frozen. Specifically, the other triggering actions may include a identification of a location of the vehicle, a speed of the vehicle and an indication that a window of the vehicle is rolled down, an indication that a fuel door of the vehicle is open, an indication that a fuel level of the vehicle is increasing, an indication that a phone call is taking place, and/or other triggering action.

Also included in the in-vehicle user interface 330 is a currently paused section 332, which provides information on the content that was playing before the content was paused. The currently paused section 332 includes a progress option 333*a*, a reverse option 333*b*, and a forward option 333*c*. The progress option 333*a* may be utilized for informing the user of the progress of the currently playing media and/or manually selecting a time on the currently playing media to play. The reverse option 333*b* may be utilized for rewinding or restarting the currently playing media. Similarly, the forward option 333*c* may be utilized for fast forwarding or skipping the currently playing media. As illustrated, the progress option 333*a* may also include a section to show the progress of the currently paused content, as well as the progress of the live content that is currently being cached. The currently stored section 332 also includes a store option 344. In response to a user indication, the entire recorded portion of the content may be stored for later retrieval.

Also included is a source option 345 for providing user options to select the source of the content. As an example, the source option 345 may provide other options for terrestrial radio, satellite radio, digital video disc, stored content, internet content, and/or other channels for receiving content. Additionally included in the in-vehicle user interface 330 is channel section 334, which provides the other channels that are available to the user. A scroll option 337 may provide additional channels that are not currently visible in the in-vehicle user interface 330.

Other options provided in the in-vehicle user interface 330 are a stored option 336, a play option 338, a preferences option 340 a sound option 342, and a navigation option 346. As discussed above, in response to selection of the stored option 336, the user may be provided with options for viewing previously stored content. The previously stored content may be stored in response to selection of the store option 344 and/or in response to other action. In response to selection of play option 338, the paused content to resume playback. Specifically, the content may be paused in response to selection of the pause option 240 from FIG. 2 and/or in response to other triggering action. Regardless, the user can override pausing the content and resume playback at the point the pause occurred by selecting the play option 338. Similarly, in some embodiments, the content may only be resumed via the play option 338 if the content was paused by a user selection of the pause option 240. Other triggering actions that cause pause of the content may require a second triggering action (such as raising the window, closing of the fuel door, etc.) to resume playback.

It should be understood that an in-vehicle presentation, such as playback of content may be altered by pausing playback of the content and/or by altering one or more audio features of the content (such as a maximum volume setting). Regardless, a triggering action generally causes this alteration of the in-vehicle presentation. While the triggering action may include a user-initiated triggering action, such as an intentional interaction with the display device 124, operational triggering actions may also cause the alteration. These operational triggering actions may include opening of a fuel door on the vehicle 102, receiving a fuel increase, rolling down a window while the vehicle is traveling below a predetermined threshold speed, detection of the vehicle in a predetermined location, etc.

Figure 4:
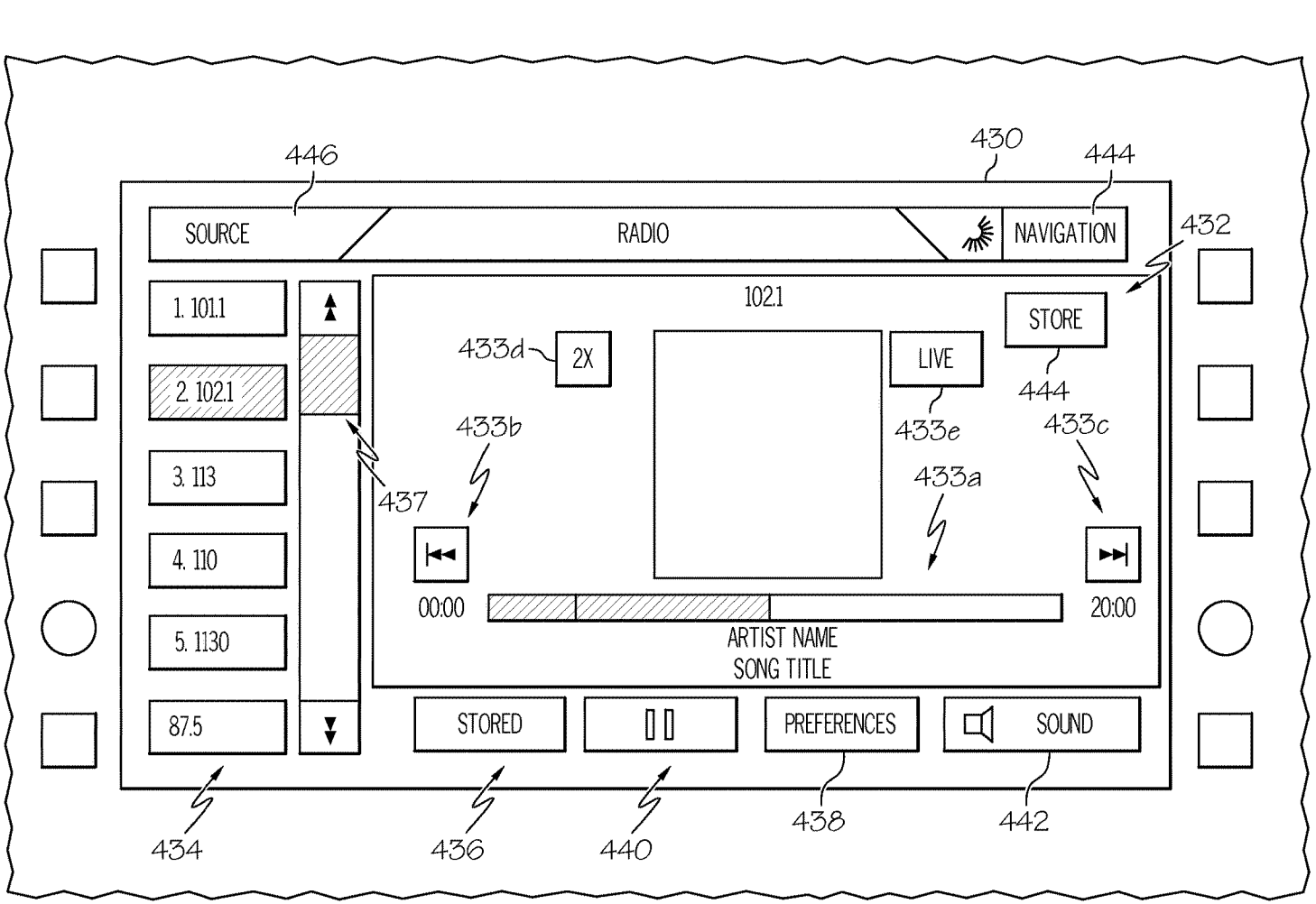
FIG. 4 depicts an in-vehicle user interface for providing playback options of paused content, such as a paused radio broadcast, according to embodiments disclosed herein.

FIG. 4 depicts an in-vehicle user interface 430 for providing playback options of paused content, such as a paused radio broadcast, according to embodiments disclosed herein. In response to selection of the play option 338 from FIG. 3 or the vehicle computing device 114 detecting other triggering action to resume playback of the content, the in-vehicle user interface 430 may be provided. Similar to the in-vehicle user interface 230 FIG. 2, the in-vehicle user interface 430 may include a currently playing section 432 that provides the content that is currently being presented. The currently playing section 432 includes a progress section 433*a* for providing the current progress of playback and the current progress of caching. Also included in the currently playing section 432 are a reverse option 433*b* and a forward option 433*c* for manipulating playback of the in-vehicle presentation accordingly.

An increased speed playback option 433*d* and a live option 433*e* are also provided. As illustrated, the increased speed playback option 433*d* may be configured to allow playback at a speed that is greater than the original broadcast, such that the user may be presented with all the content, but still catch back up with live content that is currently being broadcast. Similarly, the live option 433*e* may be configured to skip the currently cached data and return to the live broadcast immediately. Other options may also be provided, such as a commercial skip option for skipping text or other undesirable content.

Also included in the in-vehicle user interface 430 is a channel section 434, which provides the user with options for selecting available channels and a scroll option 437 for viewing additional channels. A stored option 436 is also provided, as well as a pause option 438, a preferences option 440, a sound option 442, a navigation store option 444, and a source option 446. These options may provide functionality similar to that described above.

Figure 5:
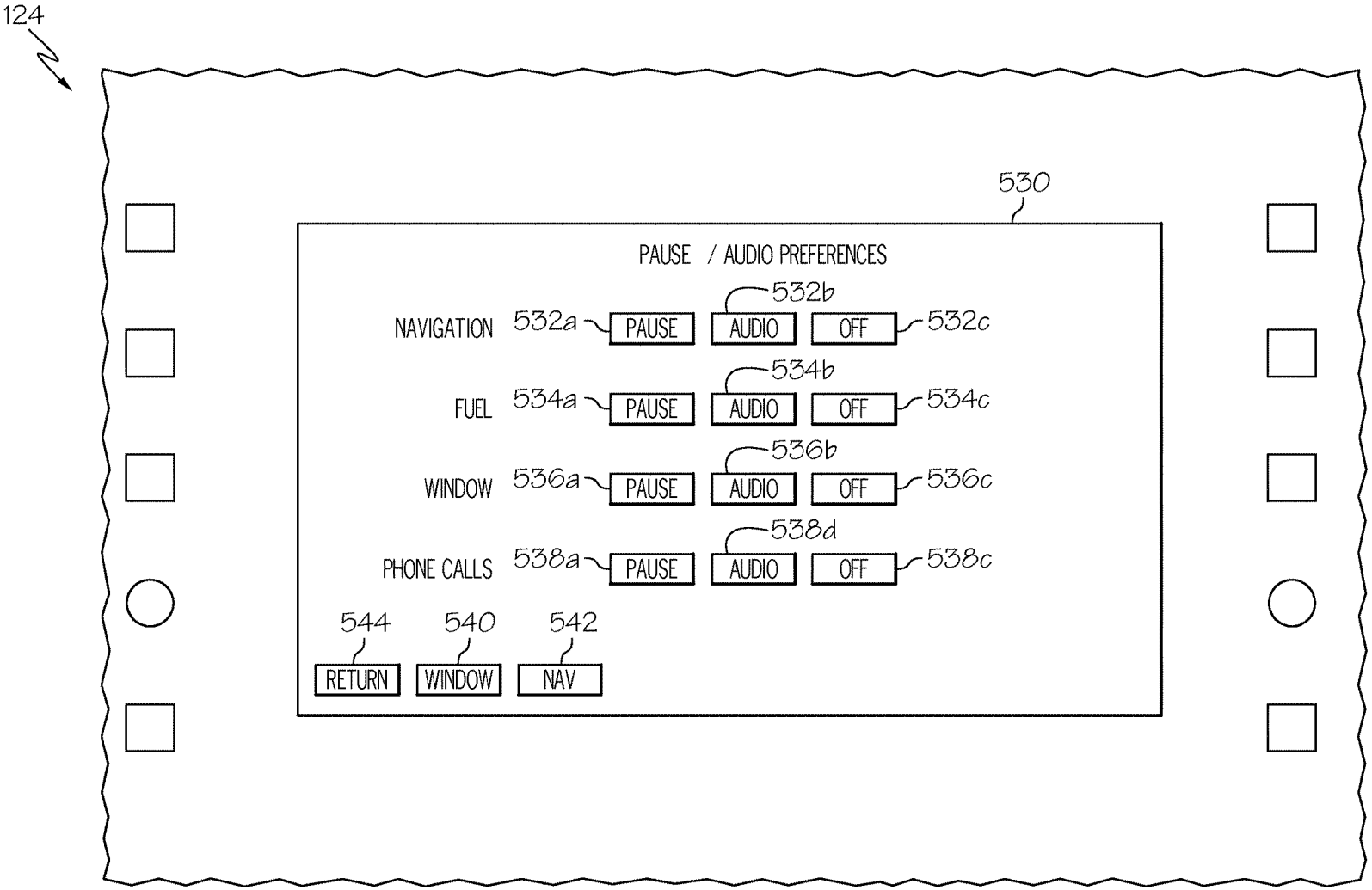
FIG. 5 depicts an in-vehicle user interface for providing window audio control preferences, according to embodiments disclosed herein.

FIG. 5 depicts an in-vehicle user interface 530 for providing window audio control preferences, according to embodiments disclosed herein. In response to selection of the preferences option 242 from FIG. 2, 340 from FIG. 3, and/or 438 from FIG. 4, the in-vehicle user interface 530 may be provided. Specifically, the in-vehicle user interface 530 may include options for defining a potential indication and/or triggering action related to altering the in-vehicle presentation. As discussed above, altering the in-vehicle presentation may include pausing and/or altering an audio characteristic of the in-vehicle presentation. The options provided in the in-vehicle user interface 530 include a pause option 532*a*, an audio option 532*b*, and an off option 534*c* related to the navigation triggering action. As discussed above, the triggering action may include one or more actions, such as a location of the vehicle 102. As a consequence, by selecting the pause option 532*a*, the user may designate that the currently playing content is paused in response to the navigation detecting the vehicle 102 is located in a predetermined location. In response to selection of the audio option 432*b*, if the vehicle 102 is detected as being located at the predetermined location, the audio setting of the content will be altered. In response to selection of the off option 534*c*, the alterations may be disabled for this triggering action.

Similarly, in response to selection of the pause option 534*a*, playback of the content may be automatically paused when the fuel door is detected as being open. In response to selection of the audio option 534*b*, an audio alteration may be made to the content when the fuel door is detected as being open. This triggering action may be disabled in response to selection of the off option 534*c*. In response to selection of the pause option 536*a*, if a window is detected as being lowered and a vehicle speed is detected as being below a predetermined threshold, the currently playing content may be paused. In response to selection of the audio option 536*b*, this triggering action may cause an alteration in the audio settings of the content. In response to selection of the off option 536*c*, this triggering action may be disabled. Similarly, in response to selection of the pause option 538*a*, detection of a phone call may pause the currently playing content. In response to selection of the audio option 538*b*

Also included in the in-vehicle user interface 530 are a window option 540, a navigation option 542, and a return option 544. In response to selection of the window option 540, additional window options may be provided, as described in more detail below. In response to selection of the navigation option 542, additional navigation options may be provided, as also described below. Selection of the return option 544 may return the user to the in-vehicle user interface 230 from FIG. 2 and/or other in-vehicle user interface.

Figure 6:
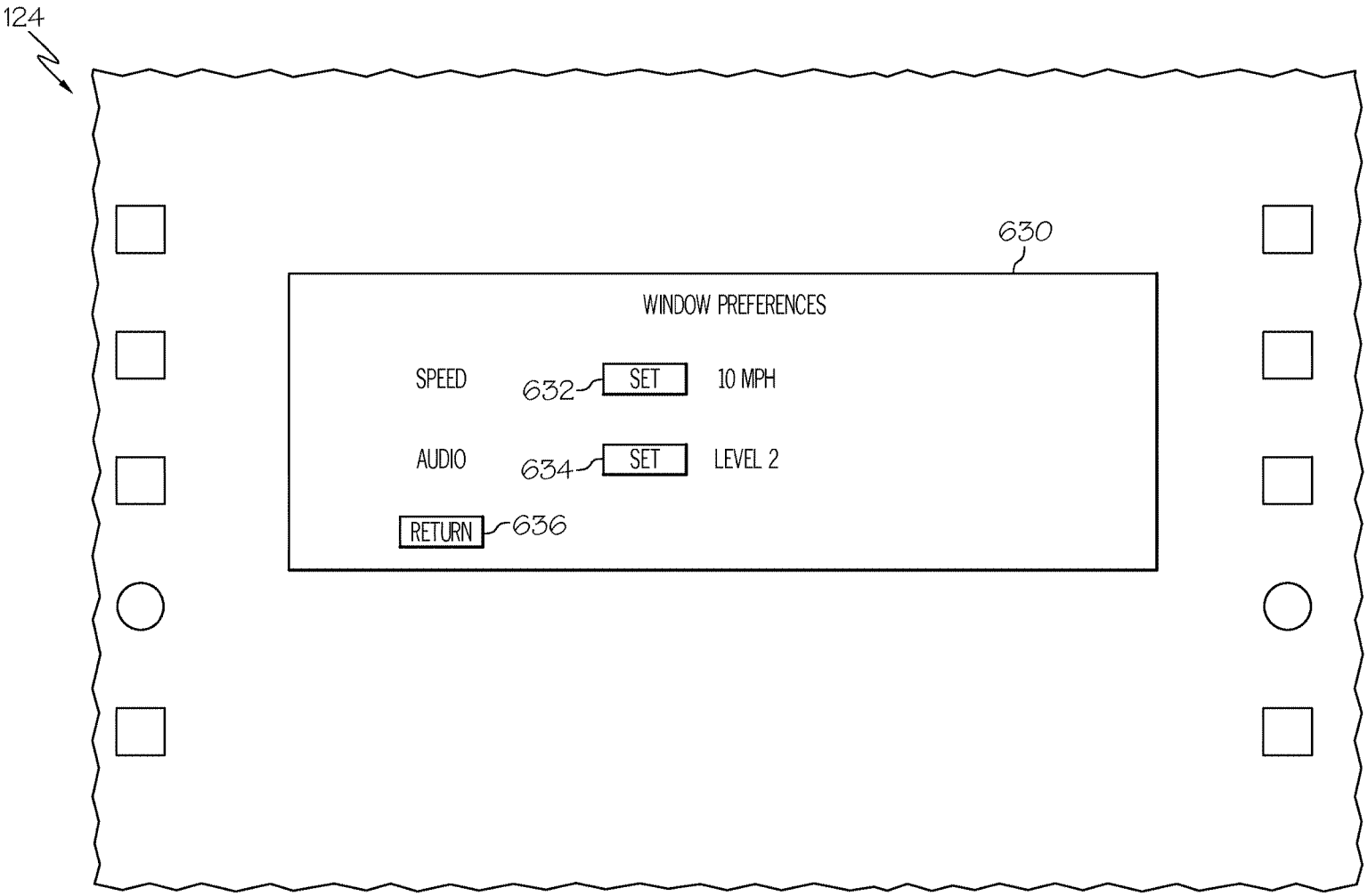
FIG. 6 depicts an in-vehicle user interface for providing window control preferences, according to embodiments disclosed herein.

FIG. 6 depicts an in-vehicle user interface 630 for providing window control preferences, according to embodiments disclosed herein. In response to selection of the window option 540 from FIG. 5, the in-vehicle user interface 630 may be provided. Specifically, the in-vehicle user interface 630 includes a speed option 632 and an audio option 634. As discussed above, one triggering action may include lowering the window while the vehicle is traveling below a predetermined speed. Accordingly, in response to selection of the speed option 632, the user may determine what the predetermined speed is for triggering alteration of the in-vehicle presentation. Similarly, the user may select the audio option 634 to determine the audio setting that is altered for the in-vehicle presentation. As an example, the user may select a maximum volume level, a balance of speaker volume in the vehicle, and an equalizer setting. In response to selection of the return option 544, the user may be navigated back to the in-vehicle user interface 230 from FIG. 2 or other in-vehicle user interface.

As another example, the vehicle computing device 114 may determine which window is lowered when the vehicle is above the predetermined speed threshold. Based on which widow is lowered, a volume, maximum volume level, bass level, and/or speaker balance may be altered to reduce the amount of sound that escapes from the lowered window. Other options may also be provided. Selection of a return option 636 may return the user to a previous user interface.

Figure 7:
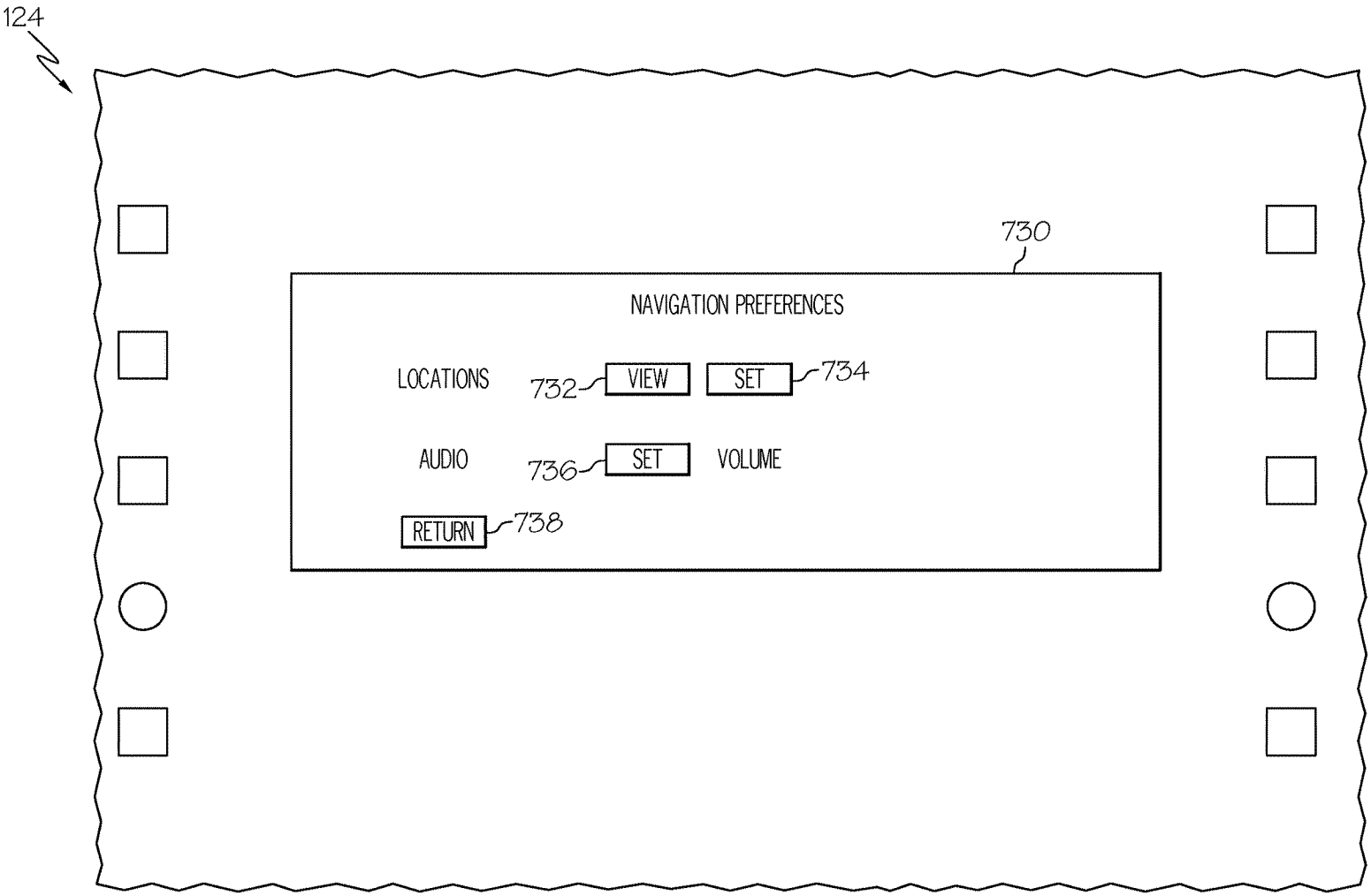
FIG. 7 depicts an in-vehicle user interface for providing navigation control preferences, according to embodiments disclosed herein.

FIG. 7 depicts an in-vehicle user interface 730 for providing navigation control preferences, according to embodiments disclosed herein. In response to selection of the navigation option 542 from FIG. 5, the in-vehicle user interface 730 may be provided. Specifically, the in-vehicle user interface 730 may include a view locations option 732 and a set locations option 734. The view locations option 732 may provide those locations that have been identified as a triggering action. These may be user defined and/or preprogrammed. As an example, if a predetermined geographic location has a noise ordinance, this location may be pre-programmed in to the vehicle computing device 114. Similarly, if the user wishes to add an additional location, the user may enter that location after selecting the set locations option 734.

Also included is an audio set option 736. The audio set option 736 may provide the user with options for determining the type of alteration that is made to the in-vehicle presentation. Specifically, the user may determine to set a maximum volume level while in the predetermined geographic location. The user may additionally identify a bass setting, a treble setting, a balance setting, and/or other audio setting that will reduce the disturbance that may be caused by the in-vehicle presentation. A return option 738 is provided for returning to a previous user interface.

Figure 8:
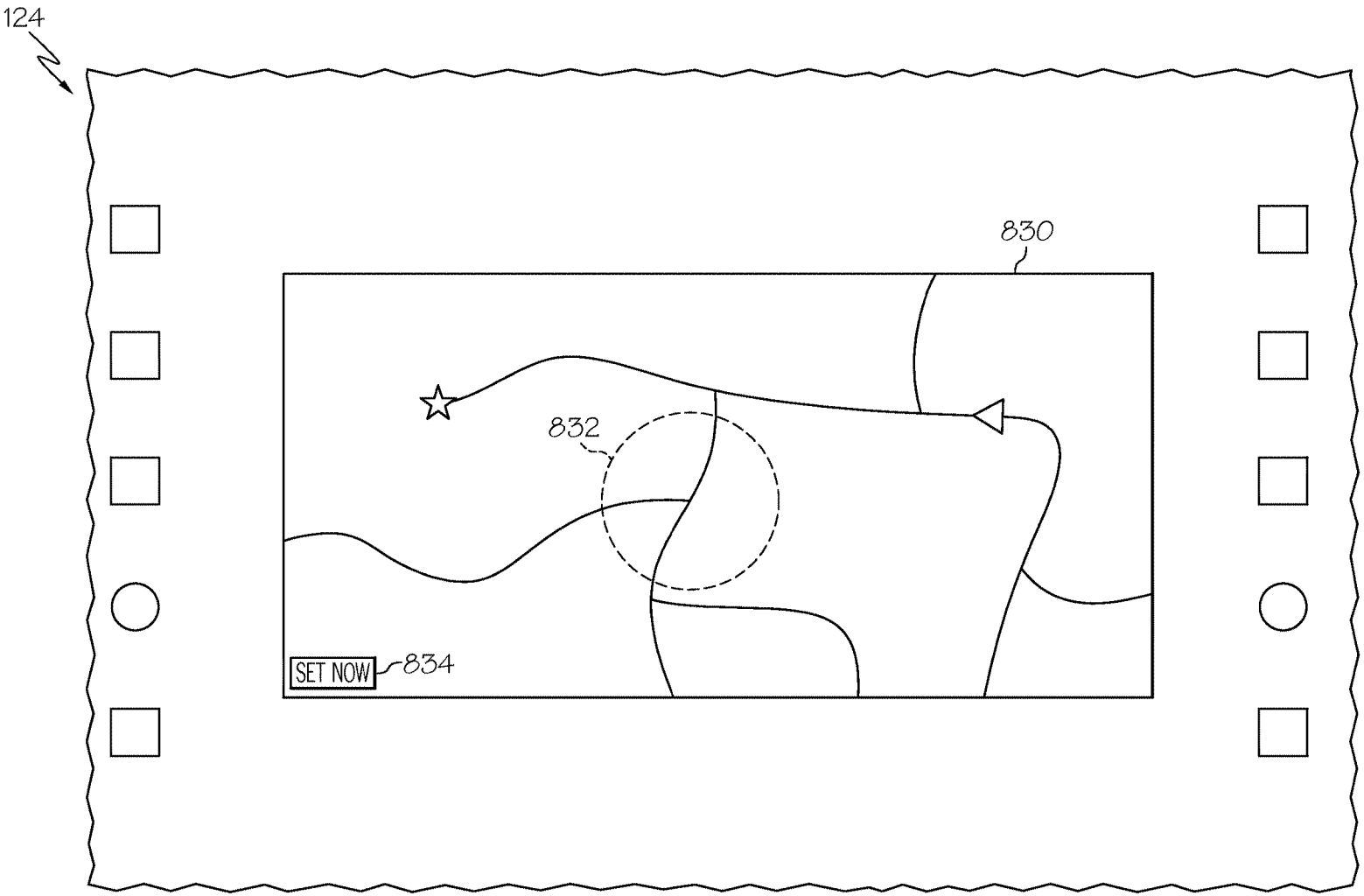
FIG. 8 depicts an in-vehicle user interface for providing navigation and volume control data, according to embodiments disclosed herein.

FIG. 8 depicts an in-vehicle user interface 830 for providing navigation and volume control data, according to embodiments disclosed herein. In response to selection of the navigation setting 246 from FIG. 2, 346 from FIG. 3, and/or 444 from FIG. 4, the in-vehicle user interface 830 may be provided. As illustrated, the in-vehicle user interface 830 may be displayed for providing navigational information to the vehicle user. The navigation data may include map data, routing data, areas where in-vehicle presentations are to be altered. As an example, the in-vehicle user interface 530 and/or 730 from FIGS. 5 and 7, respectively, settings for altering the in-vehicle presentation may be made. One example includes altering the in-vehicle presentation, based on the geographic location of the vehicle 102. As such, these locations may be graphically depicted in the in-vehicle user interface 830 via an indicator 852. Also provided is a set option 834 for setting the current vehicle location as a geographical area for altering the in-vehicle presentation.

Figure 9:
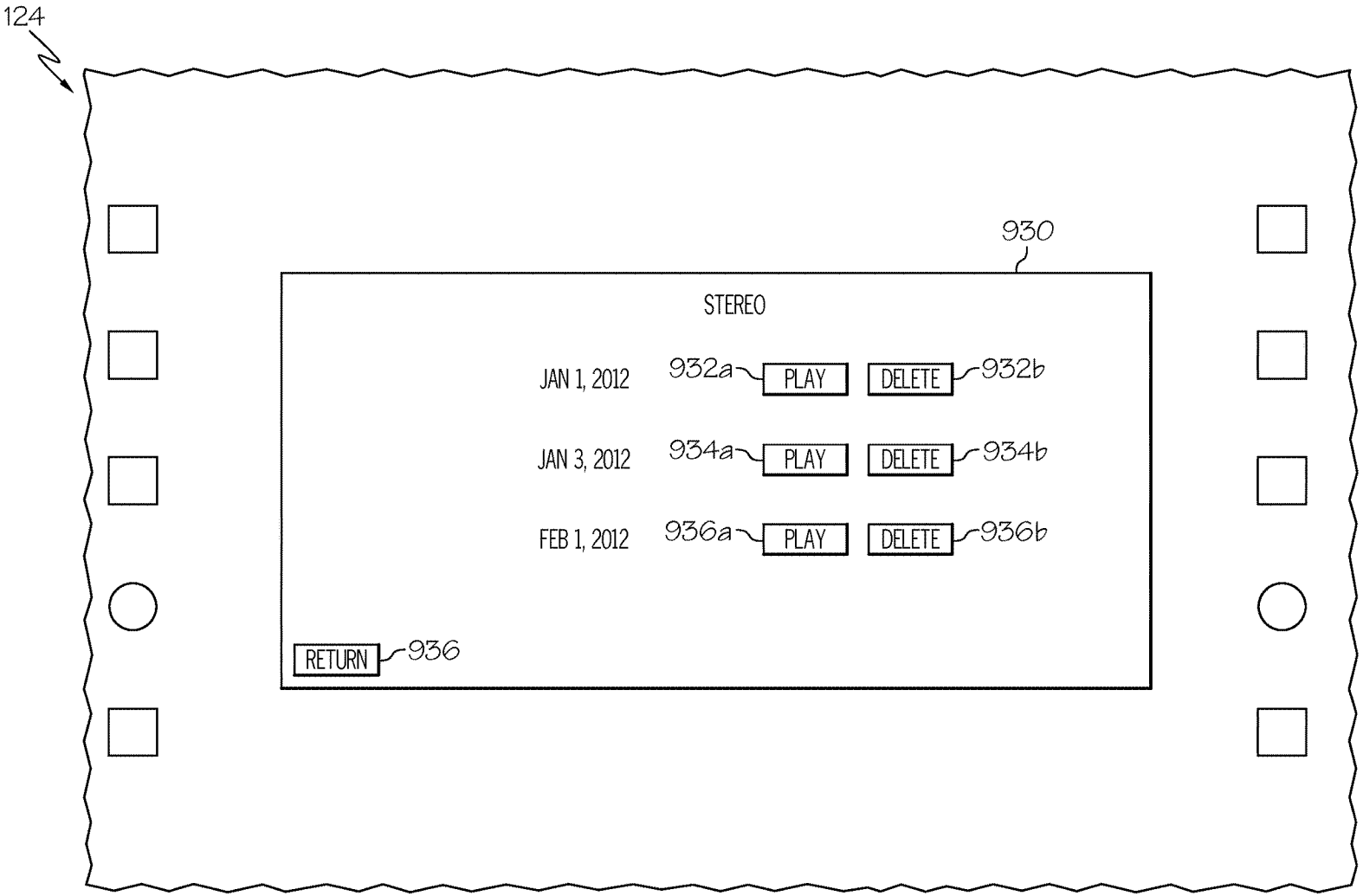
FIG. 9 depicts an in-vehicle user interface for providing playback preferences of stored content, according to embodiments disclosed herein.

FIG. 9 depicts an in-vehicle user interface 930 for providing playback preferences of stored content, according to embodiments disclosed herein. In response to selection of the stored option 238 from FIG. 2, 336 from FIG. 3, and/or 440 from FIG. 4, stored content may be provided in the in-vehicle user interface 930. Specifically, if the content has been paused, the vehicle computing device 114 may additionally cache and/or record the content. The recorded content may be stored only until viewed or skipped by the user and may then be discarded. In some embodiments however, the user may wish to store the recorded content for later viewing (such as if the user does not want to miss the current content, but wants to view the recorded content later) As such, the user may store the content permanently and/or semi-permanently. The stored content may be accessible via the in-vehicle user interface 930, which may include play options 932*a*, 932*b*, 932*c* and/or delete options 934*a*, 934*b*, 934*c*. Selection of a return option 936 may return the user to a previous in-vehicle user interface.

Figure 10:
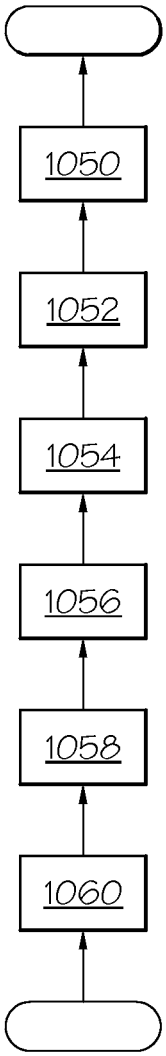
FIG. 10 depicts a flowchart for altering an in-vehicle presentation, according to embodiments disclosed herein.

FIG. 10 depicts a flowchart for altering an in-vehicle presentation, according to embodiments disclosed herein. As illustrated in block 1050, a media signal may be received, where the media signal includes content. In block 1052, an in-vehicle presentation of the content may be provided for viewing as the media signal is being received. Specifically, in some embodiments, the media signal may include a terrestrial and/or satellite radio signal. As radio signal is being received, the content playback device 110 (FIG. 1) will present the content in real-time (or near-real-time). In block 1054, an indication to alter output of the in-vehicle presentation in a predetermined manner may be received. As discussed above, the predetermined manner may include pausing the playback of the radio signal and/or altering an audio characteristic of the in-vehicle presentation. Regardless, in block 1056, in response to receiving the indication, the in-vehicle presentation may be altered in the predetermined manner. In block 1058, in response to altering the in-vehicle presentation, recording of the content may begin. In block 1060, an option to store the content that is being recorded may be provided.

FIG. 11 depicts a network environment for altering an in-vehicle presentation, according to embodiments disclosed herein. The vehicle 102 is depicted in FIG. 11 as an automobile but may be any passenger or non-passenger vehicle such as, for example, a terrestrial, aquatic, and/or airborne vehicle. The vehicle 102 may be coupled to a remote computing device 1104 and/or a user computing device 1106 for receiving content and/or other data via a network 1100. The network may include a wide area network, local area network, and/or other wired or wireless network for communicating data, as described herein.

Also illustrated is the vehicle computing device 114, which includes the processor 132, input/output hardware 1108, the network interface hardware 1150, a data storage component 1136 (which stores trigger data 1138*a*, action data 1138*b*, and/or other data), and the memory component 134. The memory component 134 may be configured as volatile and/or nonvolatile memory and as such, may include random access memory (including SRAM, DRAM, and/or other types of RAM), flash memory, secure digital (SD) memory, registers, compact discs (CD), digital versatile discs (DVD), and/or other types of non-transitory computer-readable mediums. Depending on the particular embodiment, these non-transitory computer-readable mediums may reside within the vehicle computing device 114 and/or external to the vehicle computing device 114.

The memory component 134 may store operating logic 1142, the altering logic 144*a* and the triggering logic 144*b*. The altering logic 144*a* and the triggering logic 144*b* may each include a plurality of different pieces of logic, each of which may be embodied as a computer program, firmware, and/or hardware, as an example. A local interface 1134 is also included in FIG. 11 and may be implemented as a bus or other communication interface to facilitate communication among the components of the vehicle computing device 114.

The processor 132 may include any processing component operable to receive and execute instructions (such as from a data storage component 1136 and/or the memory component 134). As described above, the input/output hardware 1108 may include and/or be configured to interface with the components of FIG. 11. As an example, the input/output hardware 1108 may include the microphones 120, the speakers 122, the display device 124, and/or other hardware in the vehicle 102

The network interface hardware 1150 may include and/or be configured for communicating with any wired or wireless networking hardware, including an antenna, a modem, LAN port, wireless fidelity (Wi-Fi) card, WiMax card, mobile communications hardware, and/or other hardware for communicating with other networks and/or devices. From this connection, communication may be facilitated between the vehicle computing device 114 and other computing devices.

The operating logic 1142 may include an operating system and/or other software for managing components of the vehicle computing device 114. Similarly, as discussed above, the altering logic 144*a* may reside in the memory component 134 and may be configured to cause the processor 132 to provide one or more of the user interfaces described herein. Similarly, the triggering logic 144*b* may be utilized to determine the triggering action for implementing the functionality described herein.

It should be understood that while the components in FIG. 11 are illustrated as residing within the vehicle computing device 114, this is merely an example. In some embodiments, one or more of the components may reside external to the vehicle computing device 114. It should also be understood that, while the vehicle computing device 114 is illustrated as a single device, this is also merely an example. In some embodiments, the altering logic 144*a* and the triggering logic 144*b* may reside on different computing devices. As an example, one or more of the functionality and/or components described herein may be provided by a remote computing device 1104 and/or user computing device 1106, which may be coupled to the vehicle 102 via a network 1100, which may be embodied as a wide area network and/or local area network.

Additionally, while the vehicle computing device 114 is illustrated with the altering logic 144*a* and the triggering logic 144*b* as separate logical components, this is also an example. In some embodiments, a single piece of logic may cause the vehicle computing device 114 to provide the described functionality.

As illustrated above, various embodiments for altering an in-vehicle presentation are disclosed. As an example, some embodiments may automatically pause a received radio broadcast and provide a user option to store the paused content for later viewing. Pausing the received radio broadcast may occur in response to a triggering option. This not only allows the user to view all desired content, but also reduces noise that resonates from the vehicle. Similarly, in some embodiments audio characteristics of the broadcast may be altered for serving this purpose.

While particular embodiments and aspects of the present disclosure have been illustrated and described herein, various other changes and modifications can be made without departing from the spirit and scope of the disclosure. Moreover, although various aspects have been described herein, such aspects need not be utilized in combination. Accordingly, it is therefore intended that the appended claims cover all such changes and modifications that are within the scope of the embodiments shown and described herein.

What is claimed is:

1. A method for altering an in-vehicle presentation comprising:

providing a user option for a user of a vehicle to identify a new geographic location, such that after the new geographic location has been identified and the vehicle reaches the new geographic location, the vehicle triggers an alteration to an in-vehicle presentation, based on predetermined criteria;

receiving user input to the user option to identify the new geographic location for altering the in-vehicle presentation when the vehicle reaches the new geographic location;

determining a vehicle location of the vehicle;

receiving a media signal at the vehicle, the media signal including content;

providing the in-vehicle presentation of the content for viewing as the media signal is being received;

determining whether a local noise ordinance exists in the vehicle location;

determining whether the vehicle location is the new geographic location identified by the user;

in response to determining that the vehicle location is the new geographic location identified by the user, adjusting the in-vehicle presentation according to a user-defined selection;

in response to determining that the local noise ordinance exists in the vehicle location, determining whether a volume of the in-vehicle presentation violates the local noise ordinance;

in response to determining that the volume violates the local noise ordinance, altering the in-vehicle presentation according to the user-defined selection such that the in-vehicle presentation will comply with the local noise ordinance, wherein altering the in-vehicle presentation includes pausing playback of the in-vehicle presentation;

in response to altering the in-vehicle presentation, beginning recording of the content;

providing an option to store the content that is being recorded; and in response to a determination that the vehicle has left the vehicle location, resuming playback of the in-vehicle presentation at a point the in-vehicle presentation was paused and providing an option to playback the in-vehicle presentation at a predetermined increased speed to allow the user to perceive the in-vehicle presentation as well as return the in-vehicle presentation to a point such that the in-vehicle presentation may be provided at a normal playback speed as the media signal is being received.

2. The method of claim 1, further comprising at least one of the following: lowering a maximum volume level of the in-vehicle presentation, adjusting a balance of speaker volume in the vehicle, and adjusting an equalizer setting to comply with the local noise ordinance.

3. The method of claim 1, further comprising, in response to receiving an indication to store the content that is being recorded, store the content for later retrieval by the user.

4. The method of claim 1, further comprising in response to altering the in-vehicle presentation, freezing an in-vehicle user interface associated with the in-vehicle presentation.

5. The method of claim 1, further comprising providing an option to store at least a portion of the in-vehicle presentation at a point in time after altering the in-vehicle presentation.

6. The method of claim 1, further comprising providing a user option to define a potential indication for altering the in-vehicle presentation.

7. A system for altering an in-vehicle presentation, comprising:

a memory component that stores logic that, when executed by the system, causes the system to perform at least the following:

determine a location of a vehicle;

provide a user option for a user to identify a new geographic location, such that when the vehicle reaches the new geographic location, the vehicle triggers an alteration to an in-vehicle presentation, based on predetermined criteria;

receive user input to the user option to identify the new geographic location for altering the in-vehicle presentation when the vehicle reaches the new geographic location;

receive a media signal for presentation in the vehicle, the media signal including recorded content;

provide an in-vehicle presentation of the recorded content for viewing as the media signal is being received;

determine whether a local noise ordinance exists in the vehicle location;

determine whether the vehicle location is the new geographic identified by the user;

in response to determining at least one of the following: that the local noise ordinance exists in the vehicle location and that the vehicle location is the new geographic location identified by the user, determine whether a volume of the in-vehicle presentation violates the local noise ordinance;

in response to determining that the volume violates the local noise ordinance, pause the in-vehicle presentation and begin recording the recorded content;

in response to determining that the vehicle has left the vehicle location, resume playback of the in-vehicle presentation at a point the in-vehicle presentation was paused; and provide an option to playback the in-vehicle presentation at a faster pace than an original pace of in-vehicle presentation until the playback reaches an end of the recorded content, wherein recording continues until the playback reaches the end of the recorded content.

8. The system of claim 7, wherein the logic further causes the system to perform at least the following:

provide an option to store the recorded content;

receive an user indication to store the recorded content; and store the recorded content for later retrieval, wherein storing the recorded content comprises at least one of the following: storing the recorded content locally and storing the recorded content remotely.

9. The system of claim 8, wherein the logic further causes the system to provide an option to playback the recorded content that has been stored.

10. The system of claim 7, wherein the logic further causes the system to provide a user interface to define a first triggering action and a second triggering action.

11. The system of claim 7, wherein in response to determining that the local noise ordinance does not exist in the vehicle location, the logic further causes the system to determine whether a vehicle user has previously identified the vehicle location as a location for pausing the in-vehicle presentation.

12. A vehicle for altering an-in-vehicle presentation comprising:

an in-vehicle audio system; and a vehicle computing device that stores logic that, when executed by the vehicle computing device, causes the vehicle computing device to perform at least the following:

provide a user option for a user to identify a new geographic location, such that when the vehicle reaches the new geographic location, the vehicle triggers an alteration to an in-vehicle presentation, based on predetermined criteria;

receive user input to the user option to identify the new geographic location for altering the in-vehicle presentation when the vehicle reaches the new geographic location;

receive a media signal, the media signal including content;

provide an in-vehicle presentation of the content for viewing, as the media signal is being received;

determine a vehicle location;

determine whether a local noise ordinance exists in the vehicle location;

determine whether the vehicle location is the new geographic location identified by the user;

in response to determining that the local noise ordinance exists, determine a maximum audio setting, based on the local noise ordinance;

in response to determining at least one of the following: that the local noise ordinance exists in the vehicle location and that he vehicle location is the new geographic identified by the user, determine whether a volume of the in-vehicle presentation exceeds the maximum audio setting;

in response to determining that the volume exceeds the maximum audio setting, pause playback of the in-vehicle presentation, determine whether a current volume is greater than the maximum audio setting, and in response to determining that the current volume is greater than the maximum audio setting, lower the current volume to the maximum audio setting; and in response to determining that the vehicle has left the vehicle location, resume playback of the in-vehicle presentation at a point where the in-vehicle presentation was paused, and provide an option to playback the in-vehicle presentation at a predetermined increased speed to allow the user to perceive the in-vehicle presentation as well as return the in-vehicle presentation to a point such that the in-vehicle presentation may be provided at a normal playback speed as the media signal is being received.

13. The vehicle of claim 12, wherein in response to determining that the local noise ordinance does not exist in the vehicle location, the logic further causes the vehicle computing device to determine whether a vehicle user has previously identified the vehicle location as a location for pausing the in-vehicle presentation.

14. The vehicle of claim 12, wherein the logic further causes the vehicle computing device to provide a user option to define a potential indication for altering the in-vehicle presentation.

15. The vehicle of claim 12, wherein in response to altering the in-vehicle presentation, the logic further causes the vehicle computing device to freeze an in-vehicle user interface associated with the presentation.

* * * * *